US010541517B2

(12) United States Patent
Hattori et al.

(10) Patent No.: US 10,541,517 B2
(45) Date of Patent: Jan. 21, 2020

(54) SPARK PLUG FOR INTERNAL COMBUSTION ENGINE AND METHOD FOR MANUFACTURING THE SAME

(71) Applicant: DENSO CORPORATION, Kariya, Aichi-pref. (JP)

(72) Inventors: Kenji Hattori, Kariya (JP); Teiji Ishinada, Kariya (JP); Ryuichi Ohno, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 16/381,099

(22) Filed: Apr. 11, 2019

(65) Prior Publication Data

US 2019/0237942 A1 Aug. 1, 2019

Related U.S. Application Data

(63) Continuation of application No. PCT/JP2017/031430, filed on Aug. 31, 2017.

(30) Foreign Application Priority Data

Oct. 12, 2016 (JP) ..... 2016-200847

(51) Int. Cl.

| | |
|---|---|
| ***H01T 13/32*** | (2006.01) |
| ***H01T 13/08*** | (2006.01) |
| ***H01T 13/39*** | (2006.01) |
| ***H01T 21/02*** | (2006.01) |

(52) U.S. Cl.

CPC ..... *H01T 13/32* (2013.01); *H01T 13/08* (2013.01); *H01T 13/39* (2013.01); *H01T 21/02* (2013.01)

(58) Field of Classification Search

CPC ..... H01T 13/05; H01T 13/04; H01T 13/06; H01T 13/41; H01T 13/08; H01T 13/34

See application file for complete search history.

(56) References Cited

U.S. PATENT DOCUMENTS

| | | | | |
|---|---|---|---|---|
| 6,470,845 | B2 * | 10/2002 | Kanao | H01T 13/39 123/169 EL |
| 2002/0067111 | A1 | 6/2002 | Shibata et al. | |
| 2005/0029915 | A1 | 2/2005 | Yorita et al. | |
| 2005/0264151 | A1 * | 12/2005 | Mori | H01T 13/20 313/141 |
| 2010/0213812 | A1 | 8/2010 | Kawashima et al. | |
| 2011/0210659 | A1 | 9/2011 | Suzuki et al. | |

(Continued)

*Primary Examiner* — Tracie Y Green

(74) *Attorney, Agent, or Firm* — Nixon & Vanderhye P.C.

(57) ABSTRACT

A spark plug includes: a mounting bracket; a center electrode having a first end portion exposed and extended from first end portion of the mounting bracket; a slant-shape ground electrode that has first end side joined to the first end portion of the mounting bracket, has a surface of the second end side extended to be opposed to the first end portion of the center electrode, and has an extension direction inclined with respect to the center electrode; a convex portion protruding from a base material of the ground electrode on the surface thereof toward the center electrode, inclines toward the center electrode with respect to a protrusion direction, and has a convex portion opposed surface opposed to an end surface of the center electrode; and a precious metal layer formed on at least the convex portion opposed surface out of surfaces of the convex portion.

12 Claims, 7 Drawing Sheets

(56) References Cited

U.S. PATENT DOCUMENTS

2013/0099652 A1* 4/2013 Below ..... H01T 13/02
313/140
2014/0333195 A1* 11/2014 Nishikawa ..... H01T 13/32
313/141

* cited by examiner

SPARK PLUG FOR INTERNAL COMBUSTION ENGINE AND METHOD FOR MANUFACTURING THE SAME

CROSS-REFERENCE TO RELATED APPLICATION

This application is a continuation application of International Application No. PCT/JP2017/031430 filed Aug. 31, 2017 which designated the U.S. and claims priority to Japanese Patent Application No. 2016-200847 filed on Oct. 12, 2016, the contents of which are incorporated herein by reference.

TECHNICAL FIELD

The present disclosure relates to a spark plug for internal combustion engine used in an engine of an automobile and others, and a method for manufacturing the same.

BACKGROUND

There has been conventionally known a configuration of a spark plug in which a convex portion is provided on an opposed surface of a ground electrode as a surface on a center electrode side by forming a convexity on part of a base material of the ground electrode to protrude toward the center electrode.

SUMMARY

The present disclosure is a spark plug that includes: a cylindrical mounting bracket attachable to an internal combustion engine; a center electrode that is held by the mounting bracket in an insulated manner and has a first end portion exposed and extended from a first end portion of the mounting bracket; a slant-shape ground electrode that has a first end side joined to the first end portion of the mounting bracket, has a surface of a second end side extending to be opposed to the first end portion of the center electrode, and has an extension direction inclined with respect to the center electrode; a convex portion that protrudes from a base material of the ground electrode on the surface of the ground electrode facing the center electrode, inclines to the center electrode side with respect to a protrusion direction, and has a convex portion opposed surface opposed to an end surface of the center electrode; and a precious metal layer that is formed on at least the convex portion opposed surface out of surfaces of the convex portion.

DETAILED DESCRIPTION OF THE PREFERRED EMBODIMENTS

Figure 1:
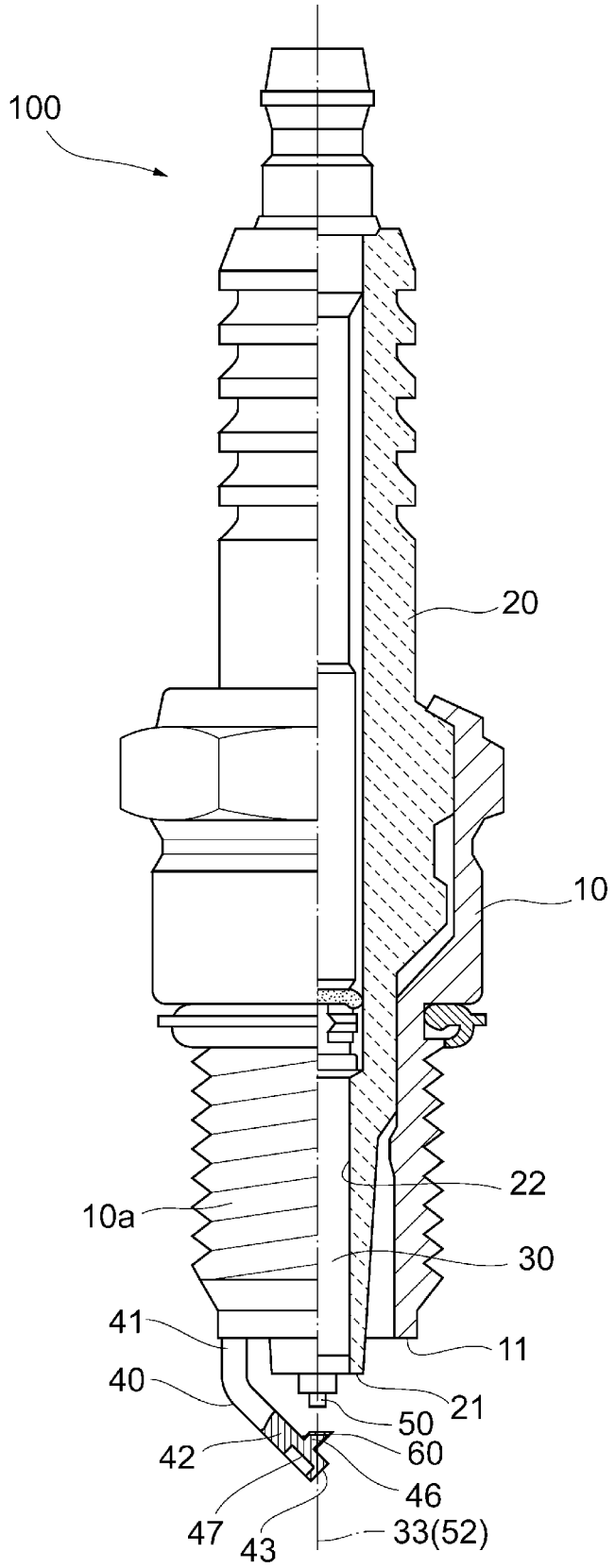
FIG. 1 is a semi-cross-sectional view of a spark plug according to an embodiment.

According to the known configuration of a spark plug, a precious metal layer can be provided on a discharge surface as a tip surface of the convex portion by welding a precious metal chip to a portion of the base material of the ground electrode where the discharge surface as the tip surface of the convex portion is to be formed to form a fuse solidification portion by fusing with the base material, and then forming the convex portion by extrusion molding. In addition to the tip surface, a precious metal layer can be provided by the same processing method on the side surfaces and corners between the tip surface and the side surfaces of the convex portion. Covering most of the convex portion with a precious metal layer makes it possible to suppress the corners from wearing that are likely to be worn due to discharge and avoid defects such as oxidation, cracking, and peeling of the fuse solidification portion.

In recent years, there has been known a slant-ground plug structure in which a ground electrode is inclined at an acute angle with respect to a center electrode. In the case of applying a known configuration of a ground electrode with a concave portion to slant grounding, the center electrode and the ground electrode are obliquely opposed to each other. When a spark plug is discharged in this positional relationship between the electrodes, the center electrode greatly suffers uneven wear in particular. Accordingly, a spark discharge gap is early extended between the center electrode and the ground electrode, which may lead to a higher required voltage.

An object of the present disclosure is to provide a spark plug that preferably suppresses uneven wear on a center electrode in a configuration using a slant-shape ground electrode.

The present disclosure is a spark plug that includes: a cylindrical mounting bracket attachable to an internal combustion engine; a center electrode that is held by the mounting bracket in an insulated manner and has first end portion exposed and extended from first end portion of the mounting bracket; a slant-shape ground electrode that has first end side joined to the first end portion of the mounting bracket, has a surface of the second end side extending opposed to the first end portion of the center electrode, and has an extension direction inclined with respect to the center electrode; a convex portion that protrudes from a base material of the ground electrode on the surface of the ground electrode facing the center electrode, inclines toward the center electrode with respect to a protrusion direction, and has a convex portion opposed surface opposed to an end surface of the center electrode; and a precious metal layer that is formed on at least the convex portion opposed surface out of surfaces of the convex portion.

According to this configuration, even when the base material of the slant-shape ground electrode is inclined with respect to the center electrode, by providing the convex portion on the ground electrode so as to have the convex portion opposed surface inclined to the center electrode side, the convex portion opposed surface of the convex portion of the ground electrode can be easily made to face the end surface of the center electrode. Accordingly, it is possible to avoid uneven wear on the center electrode that is likely to occur when the end surfaces of the center electrode and the ground electrode are obliquely opposed to each other in the spark discharge gap between the center electrode and the ground electrode.

According to the present disclosure, it is possible to provide a spark plug that preferably suppresses uneven wear on the center electrode in a configuration using the slant-shape ground electrode, and a method for manufacturing the same.

An embodiment will be described below with reference to the attached drawings. For easy understanding of the description, identical components in the drawings are given identical reference signs as much as possible and duplicated descriptions thereof will be omitted.

[Embodiment]

A configuration of a spark plug 100 according to the present embodiment will be described with reference to FIGS. 1 to 3. The spark plug 100 according to the present embodiment is applied to an ignition plug of an automobile engine or the like and is inserted into and fixed to a screw hole provided in an engine head (not illustrated) defining and forming the combustion chamber of the engine.

As illustrated in FIG. 1, the spark plug 100 has a cylindrical mounting bracket 10 formed of a conductive steel material (for example, low-carbon steel or the like), and the mounting bracket 10 includes an attachment screw portion 10*a* for fixing to an engine block not illustrated. An insulator 20 formed of alumina ceramic ($Al_2O_3$) or the like is fixed to the inside of the mounting bracket 10 so that a first end portion 21 of the insulator 20 is exposed from a first end portion 11 of the mounting bracket 10.

A center electrode 30 is fixed to an axial hole 22 of the insulator 20 and is held with respect to the mounting bracket 10 in an insulated manner. The center electrode 30 is a columnar body in which an inner material is formed of a metallic material such as Cu excellent in heat conductivity and an outer material is formed of a metallic material such as a Ni-base alloy excellent in heat resistance and corrosion resistance. As illustrated in FIG. 2, the center electrode 30 has a first end portion 31 decreased in diameter and exposed and extended from the first end portion 21 of the insulator 20.

On the other hand, a ground electrode 40 has a pillar shape (for example, prismatic shape) that is fixed at a first end portion 41 by welding to the first end portion 11 of the mounting bracket 10, bent in the middle, and extended on the side of a second end portion 42 toward the first end portion 31 of the center electrode 30 to form an acute angle with an axis 33 of the center electrode.

Figure 2:
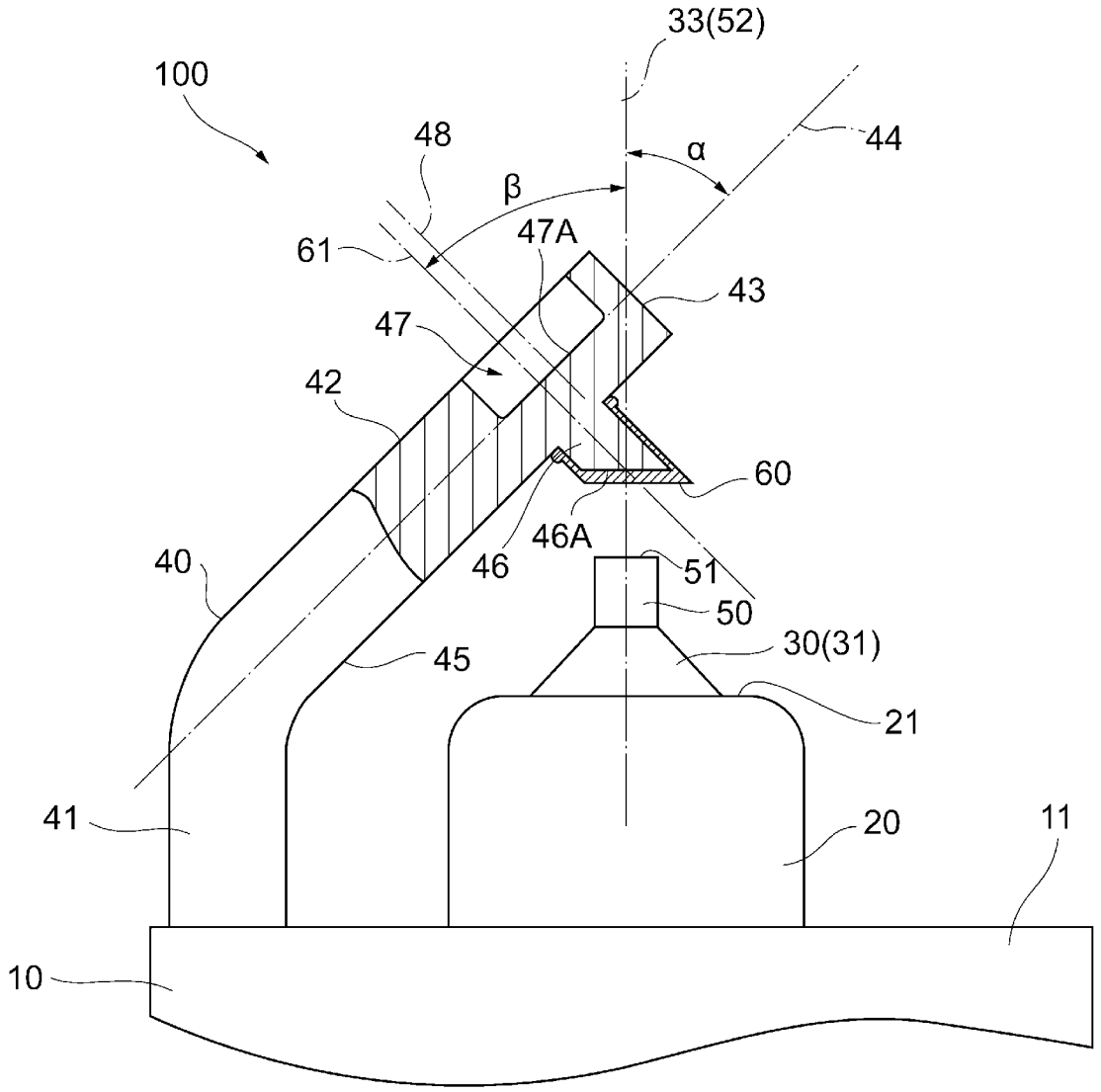
FIG. 2 is an enlarged view of a spark discharge part and its vicinity in the spark plug illustrated in FIG. 1.

That is, as illustrated in FIG. 2, an angle $\alpha$ formed by an axis 44 of the ground electrode 40 toward an end surface 43 on the second end portion 42 side (hereinafter, called ground electrode other end surface) and the axis 33 of the center electrode 30 is an acute angle. Specifically, the ground electrode 40 has a slant shape, that is, a shape slanting with respect to the center electrode 30 as seen in an extension direction. The ground electrode 40 is formed of a Ni-base alloy with Ni as the main ingredient, for example.

The axis 44 of the ground electrode 40 toward the ground electrode other end surface 43 is an axis that extends toward the substantial ground electrode other end surface 43 of the ground electrode 40 is projected onto a virtual plane when assuming a plane including the center of gravity of a cross section of a joint portion (welded portion) between the ground electrode 40 and the mounting bracket 10 and the axis 33 of the center electrode as the virtual plane. The virtual plane is a plane parallel to the face of FIG. 2.

A center electrode-side chip 50 made of a precious metal or the like and extending in the same direction as the axis 33 of the center electrode is joined to the first end portion 31 of the center electrode 30 by laser welding, resistance welding, or the like. That is, in the present embodiment, the axis 33 of the center electrode is also an axis 52 of the center electrode-side chip 50. In this example, the axis 33 of the central axis aligns with the axis 52 of the center electrode-side chip. However, these axes may not align with each other but may extend in the same direction, that is, may be in a parallel relationship.

On the other hand, a convex portion 46 is formed on a surface 45 of the ground electrode 40 on the second end portion 42 side opposed to the center electrode 30 (hereinafter, called "opposed surface 45") to protrude from the base material of the ground electrode 40 toward the center electrode 30. The cross section of the convex portion orthogonal to the protrusion direction (the direction of the axis 61) of the convex portion 46 is circular in shape, for example. The convex portion 46 includes a convex portion opposed surface 46A that is formed to be inclined toward the center electrode 30 with respect to a protrusion direction. In other words, as illustrated in FIG. 3, the convex portion 46 is formed on the surface 45 of the ground electrode 40 such that a protrusion amount h2 on the ground electrode other end surface 43 side is larger than a protrusion amount h1 on the first end portion 41 side. Accordingly, the convex portion opposed surface 46A can be opposed to the end surface of the center electrode 30 (the tip surface 51 of the center electrode-side chip 50) as illustrated in FIG. 2. More specifically, the convex portion opposed surface 46A of the convex portion 46 is formed to be perpendicular to an axial direction of the center electrode 30 (the direction of the axis 33). A precious metal layer 60 of an approximately even thickness is formed on the convex portion 46 to cover the entire surface of the convex portion 46. The precious metal layer 60 is also a fuse solidification portion formed by fusing a precious metal chip and part of the base material of the ground electrode 40. In the present embodiment, the precious metal layer 60 has a thickness within a range of 0.1 to 0.2 mm.

The convex portion 46 and the precious metal layer 60 extend toward a tip surface 51 of the center electrode-side chip 50 such that the convex portion opposed surface 46A and the tip surface 51 of the center electrode-side chip 50 are opposed to each other with a discharge gap therebetween. Hereinafter, as illustrated in FIG. 2, the axial core of the convex portion 46 along a protrusion direction of the convex portion 46 and the precious metal layer 60 will be called "axis 61 of the convex portion 46 of the ground electrode 40").

A concave portion 47 is formed on a surface of the ground electrode 40 opposite to the opposed surface 45 to range from this surface toward the opposed surface 45. The base material of the ground electrode 40 is partially recessed along with the formation of the convex portion 46. The concave portion 47 has a bottom surface 47A perpendicular to a recessing direction. The recessing direction is identical to the protrusion direction of the convex portion 46. The concave portion 47 is formed to have the same circular shape as that of the convex portion 46 as seen from the recessing direction, for example. Hereinafter, the axial core of the concave portion 47 along the recessing direction will be expressed as "center axis 48 of the concave portion 47 of the ground electrode 40" as illustrated in FIG. 2. The center axis 48 of the concave portion 47 along the recessing direction is shifted to the other end (the ground electrode other end surface 43) side of the ground electrode 40 with respect to the center axis 61 of the convex portion 46 along the protrusion direction. In other words, the concave portion 47 of the ground electrode 40 is provided such that the axial core 48 is offset by a shift amount a to the second end side with respect to the axial core 61 of the convex portion 46.

The axis 52 of the center electrode-side chip 50 and the axis 61 of the convex portion 46 of the ground electrode 40 are in a crossing or distorted positional relationship. Specifically, a crossing angle β between the axis 52 of the center electrode-side chip and the axis 61 of the convex portion 46 of the ground electrode 40 (in the case where the axes are distorted, the crossing angle is as indicated by β in FIG. 2) is preferably 5° to 70° inclusive.

The center electrode-side chip 50 may be formed in a columnar or disc shape but is preferably formed in a columnar shape.

The material for the center electrode-side chip 50 and the precious metal layer 60 of the ground electrode 40 can be any one of alloys such as Pt (platinum)-Ir (iridium), Pt—Rh (rhodium), Pt—Ni (nickel), Ir—Rh, Ir—Y (yttrium), and others.

Further, the material for the center electrode-side chip 50 and the precious metal layer 60 of the ground electrode 40 may be an alloy in which Pt as the main ingredient is mixed with at least one of Ir, Ni, Rh, W, Pd, Ru, and Os. More specifically, the material may be an alloy in which Pt as the main ingredient is mixed with at least one of Ir of 50 weight % or less, Ni of 40 weight % or less, Rh of 50 weight % or less, W of 30 weight % or less, Pd of 40 weight % or less, Ru of 30 weight % or less, and Os of 20 weight % or less.

Further, the material for the center electrode-side chip 50 and the precious metal layer 60 of the ground electrode 40 may be an alloy in which Ir as the main ingredient is mixed with at least one of Rh, Ni, W, Pd, Ru, and Os. More specifically, the material may be an alloy in which Ir as the main ingredient is mixed with at least one of Rh of 50 weight % or less, Pt of 50 weight % or less, Ni of 40 weight % or less, W of 30 weight % or less, Pd of 40 weight % or less, Ru of 30 weight % or less, and Os of 20 weight % or less.

In the thus configured spark plug 100, electric discharge takes place in a discharge gap formed between the tip surface 51 of the center electrode-side chip 50 and the precious metal layer 60 of the ground electrode 40 to ignite the fuel-air mixture in the combustion chamber. After the ignition, a flame kernel formed in the discharge gap grows to cause combustion in the combustion chamber.

Next, a method for manufacturing the convex portion 46 of the ground electrode 40 and the precious metal layer 60 will be described with reference to FIGS. 4 and 5.

First, a precious metal chip 60A as a raw material of the precious metal layer 60 is placed at a position where the convex portion 46 is to be formed on the opposed surface 45 of the base material of the ground electrode 40, and the entire precious metal in the precious metal chip 60A and part of the base material of the ground electrode 40 are fused together by resistance welding or arc welding to form a fuse solidification portion. In arc welding, the metal ratio in the surface (discharge surface) of the fuse solidification portion and its vicinity is preferably 70% or more, and the metal ratio in the base material and its vicinity is preferably 50% or less. Examples of arc welding include plasma arc welding, shielded arc welding, submerged arc welding, inert gas welding, MAG welding (including $CO_2$ gas arc welding), and self-shielded arc welding, and others. This fusion processing can also be expressed as processing for bonding the precious metal layer 60 to one surface of the ground electrode 40 (the opposed surface 45) (bonding step).

Figure 4:
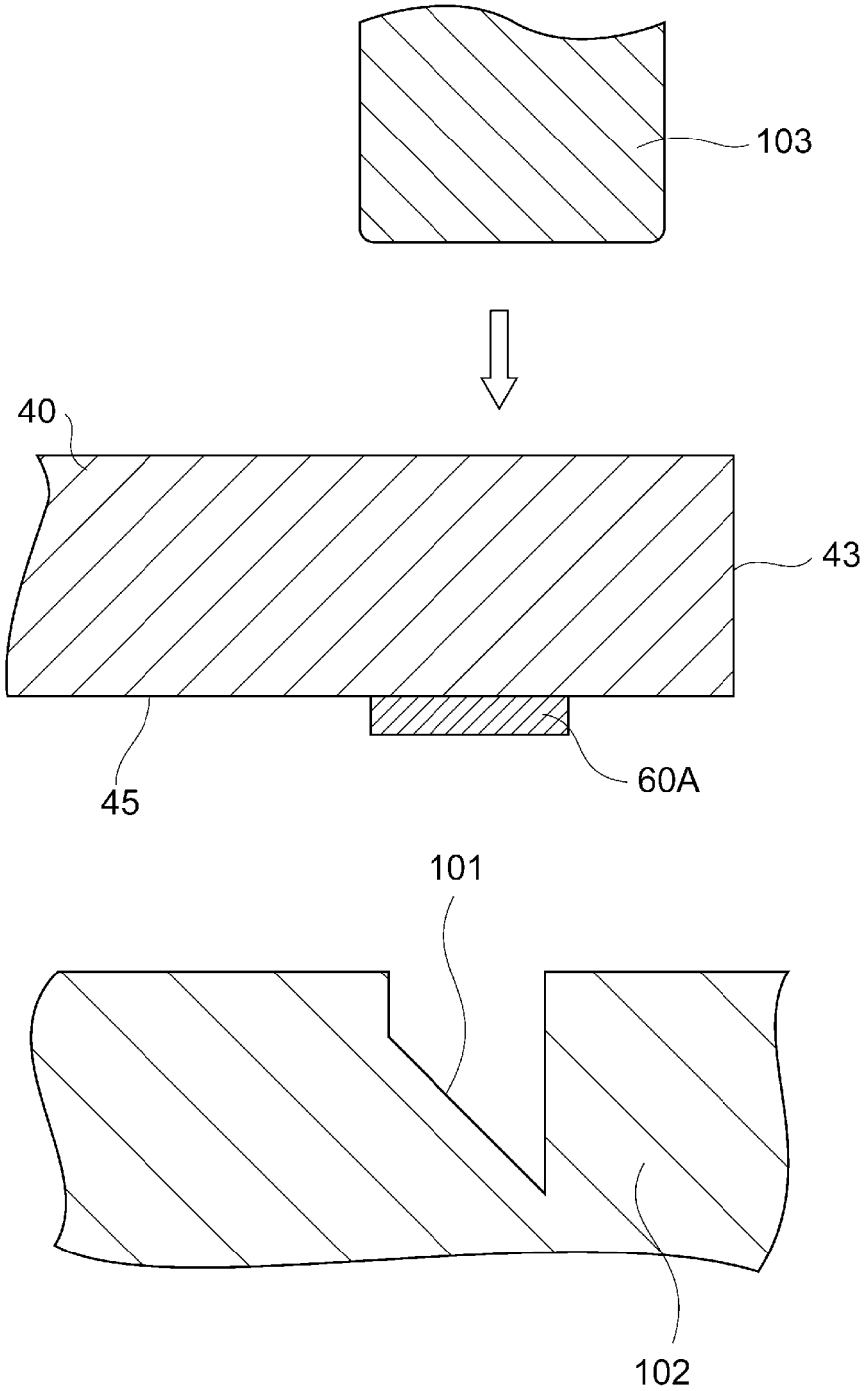
FIG. 4 is a diagram illustrating a pre-extrusion molding state of the convex portion of the ground electrode and a precious metal layer.
Figure 5:
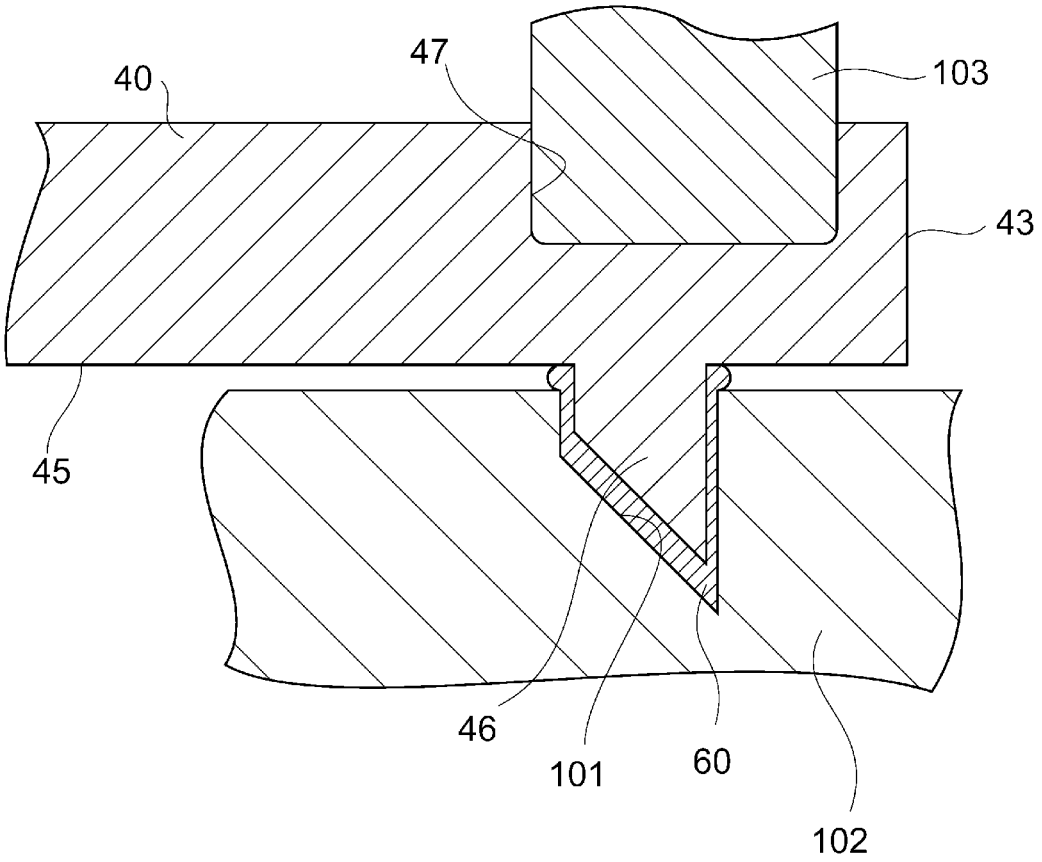
FIG. 5 is a diagram illustrating a post-extrusion molding state of the convex portion of the ground electrode and the precious metal layer.

Then, as illustrated in FIG. 4, the ground electrode 40 with the precious metal chip 60A welded is placed on a metal die 102 with a convex portion cavity 101 for forming the convex portion 46 in a state in which the convex portion cavity 101 and the opposed surface 45 are opposed to each other. The convex portion cavity 101 is columnar in shape and is formed to have a bottom surface inclined with respect to an extrusion direction. By changing the shape of the convex portion cavity 101, the protrusion amounts h1 and h2 of the completed convex portion 46, the inclination degree of the convex portion opposed surface 46A, and others can be altered.

In the present embodiment, the precious metal chip 60A is an approximately circular plate material. A diameter φ1 of the precious metal chip 60A is preferably larger than the diameter of the convex portion cavity 101 (that is, the maximum diameter of the molded convex portion 46), and the thickness t1 of the precious metal chip 60A is preferably larger than or identical to the maximum thickness t2 of the molded precious metal layer 60.

A pressing jig 103 has an approximately columnar shape, for example. The pressing jig 103 is configured such that a diameter φ2 thereof is larger than the diameter φ1 of the precious metal chip 60A and the maximum diameter of the molded convex portion 46 so that the base material is prone to protrude toward the deepest portion of the convex portion cavity 101.

The metal die 102 and the pressing jig 103 are used to perform cold-hammer forging on the flat plate-shaped ground electrode 5 to form the convex portion 46 (convex portion forming step). Specifically, as illustrated in FIG. 5, the pressing jig 103 is used to press the opposed surface 45 and part of the rear surface on the opposite side of the ground electrode 40 to form the concave portion 47, and extrude part of the base material of the ground electrode 40 toward the convex portion cavity 101 to form the convex portion 46. That is, a part of the opposed surface 45 is extruded, and the extruded ground electrode 40 is protruded by the extrusion toward the inside of the convex portion cavity 101 to form the convex portion 46 with the precious metal layer 60 provided on the entire surface as described above (precious metal layer forming step).

Figure 3:
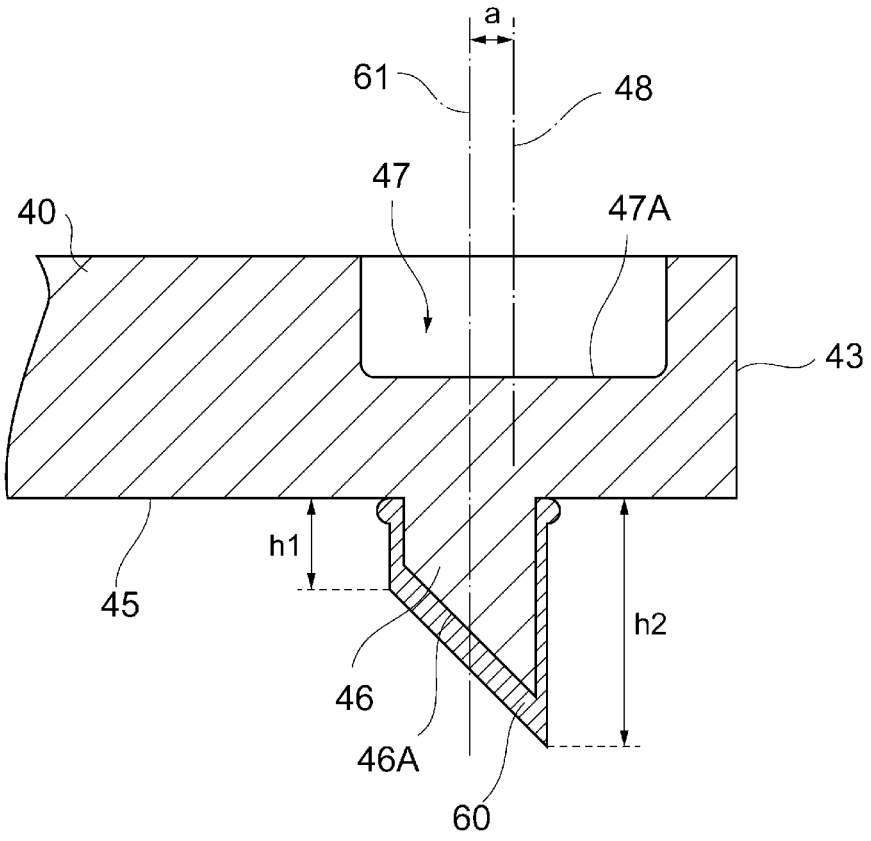
FIG. 3 is a diagram schematically illustrating a shape of a convex portion and its vicinity of a ground electrode.

Consequently, as illustrated in FIG. 3, the convex portion 46 is formed on the surface 45 side of the base material of the ground electrode 40 to have the protrusion amount h2 on the ground electrode other end surface 43 side, the protrusion amount h1 on the first end portion 41 side, and the convex portion opposed surface 46A inclined toward the first end portion 41 side with respect to the axis 61. In addition, the concave portion 47 is formed on the surface of the ground electrode 40 opposite to the surface 45 to have the bottom surface 47A orthogonal to the extrusion direction and have the center axis 48 shifted in position by the shift amount a toward the ground electrode other end surface 43 side with respect to the axis 61 of the convex portion 46

Next, advantageous effects of the spark plug 100 according to the present embodiment will be described.

The spark plug 100 of the present embodiment includes: the cylindrical mounting bracket 10 attachable to an internal combustion engine; the center electrode 30 that is held by the mounting bracket 10 in an insulated manner and has the first end portion 31 exposed and extended from the first end portion 11 of the mounting bracket 10; the slant-shape ground electrode 40 that has the first end side joined to the first end portion 11 of the mounting bracket 10, has the surface 45 of the second end side extended to be opposed to the first end portion 31 of the center electrode 30, and has the extension direction inclined with respect to the center electrode 30; the convex portion 46 that protrudes from the base material of the ground electrode 40 on the surface 45 of the ground electrode 40 toward the center electrode 30, inclines toward the center electrode 30 with respect to the protrusion direction, and has the convex portion opposed surface 46A opposed to the end surface of the center electrode 30 (the tip surface 51 of the center electrode-side chip 50); and the precious metal layer 60 that is formed on the entire surface of the convex portion 46.

According to this configuration, even when the base material of the slant-shape ground electrode 40 is inclined with respect to the center electrode 30, providing the convex portion 46 on the ground electrode 40 to have the convex portion opposed surface 46A inclined toward the center electrode 30 makes it easy to oppose the convex portion opposed surface 46A of the convex portion 46 of the ground electrode 40 to the end surface (the tip surface 51 of the center electrode-side chip 50) of the center electrode 30. Accordingly, it is possible to avoid uneven wear on the center electrode 30 that is likely to occur when the end surfaces of the center electrode 30 and the ground electrode 40 are obliquely opposed to each other in the spark discharge gap between the center electrode 30 and the ground electrode 40. As a result, it is possible to preferably suppress uneven wear on the center electrode 30 in a configuration with the slant-shape ground electrode 40. Suppressing the occurrence of uneven wear on the electrode makes it possible to lengthen the consumable life of the spark plug 100. Further, the entire convex portion 46 of the ground electrode 40 is not formed of a precious metal but the precious metal layer 60 is formed on the surface of the convex portion 46, which reduces the necessary amount of the precious metal to allow low-cost manufacture of the spark plug 100.

In the spark plug 100 of the present embodiment, the convex portion 46 of the ground electrode 40 is formed such that the convex portion opposed surface 46A is perpendicular to the axis direction of the center electrode 30.

According to this configuration, the convex portion opposed surface 46A of the ground electrode 40 is arranged to face the end surface of the center electrode 30, that is, the tip surface 51 of the center electrode-side chip 50. Accordingly, the convex portion opposed surface 46A and the tip surface 51 can be entirely at the same distance to further suppress the occurrence of uneven wear on the center electrode 30.

In the spark plug 100 of the present embodiment, the convex portion 46 of the ground electrode 40 is formed by protruding part of the base material of the ground electrode 40 by extrusion molding, and the precious metal layer 60 is welded to the surface 45 of the ground electrode 40 and then formed on the entire surface of the convex portion 46 by extrusion molding.

According to this configuration, the shape of the ground electrode 40 can be easily formed and the precious metal layer 60 can be easily formed on the surface of the convex portion 46. In addition, the formation of the convex portion 46 and the formation of the precious metal layer 60 can be performed simultaneously by one extrusion molding to decrease the number of manufacturing steps and improve the manufacturing efficiency.

The spark plug 100 of the present embodiment includes the concave portion 47 that is formed by recessing part of the base material of the ground electrode 40 along with the formation of the convex portion 46, on the surface of the ground electrode 40 opposite to the surface 45, and has the bottom surface 47A perpendicular to the recessing direction.

According to this configuration, the depth of the concave portion 47 is uniform, and the thickness of the base material between the bottom surface 47A of the concave portion 47 and the surface 45 of the ground electrode 40 is uniform. This makes it possible to suppress thinning and strength decrease of the base material at the second end portion of the ground electrode 40 due to the molding of the convex portion 46 and the concave portion 47.

In the spark plug 100 of the present embodiment, the center axis 48 of the concave portion 47 in the recessing direction is shifted to the second end side of the ground electrode 40 (the ground electrode other end surface 43 side) with respect to the center axis 61 of the convex portion 46 as seen in the protruding direction.

In the present embodiment, the shape of the convex portion 46 formed by extrusion molding is uneven with respect to the protruding direction. Specifically, the protrusion amount h2 of the convex portion 46 nearer the ground electrode other end surface 43 side than the axis 61 is larger than the protrusion amount h1 on the first end portion 41 side. When the center axis 61 of the convex portion 46 shaped as described above as seen in the protruding direction is identical to the axis of the direction of pressurization by the pressing jig 103, the flow of the metal extruded from the base material by extrusion molding becomes uneven, and thus sags may occur at the tip of the convex portion 46. In contrast to this, in the present embodiment, according to the foregoing configuration, the center axis 48 of the concave portion 47 is shifted to the ground electrode other end surface 43 side where the protrusion amount of the convex portion 46 is large to increase the amount of the metal extruded from the base material by extrusion molding on the ground electrode other end surface 43 rather than on the center axis 61 of the convex portion 46. This improves uneven state of flow of the metal extruded from the base material of the ground electrode 40. Therefore, the processing accuracy of the convex portion 46 of the ground electrode 40 can be improved.

In the spark plug 100 of the present embodiment, the convex portion 46 is columnar in shape and the cross section of the convex portion 46 is circular in shape. According to this configuration, the shape of the convex portion cavity 101 can be simplified to improve the ease of processing and reduce manufacturing costs.

MODIFICATION EXAMPLES

Figure 6:
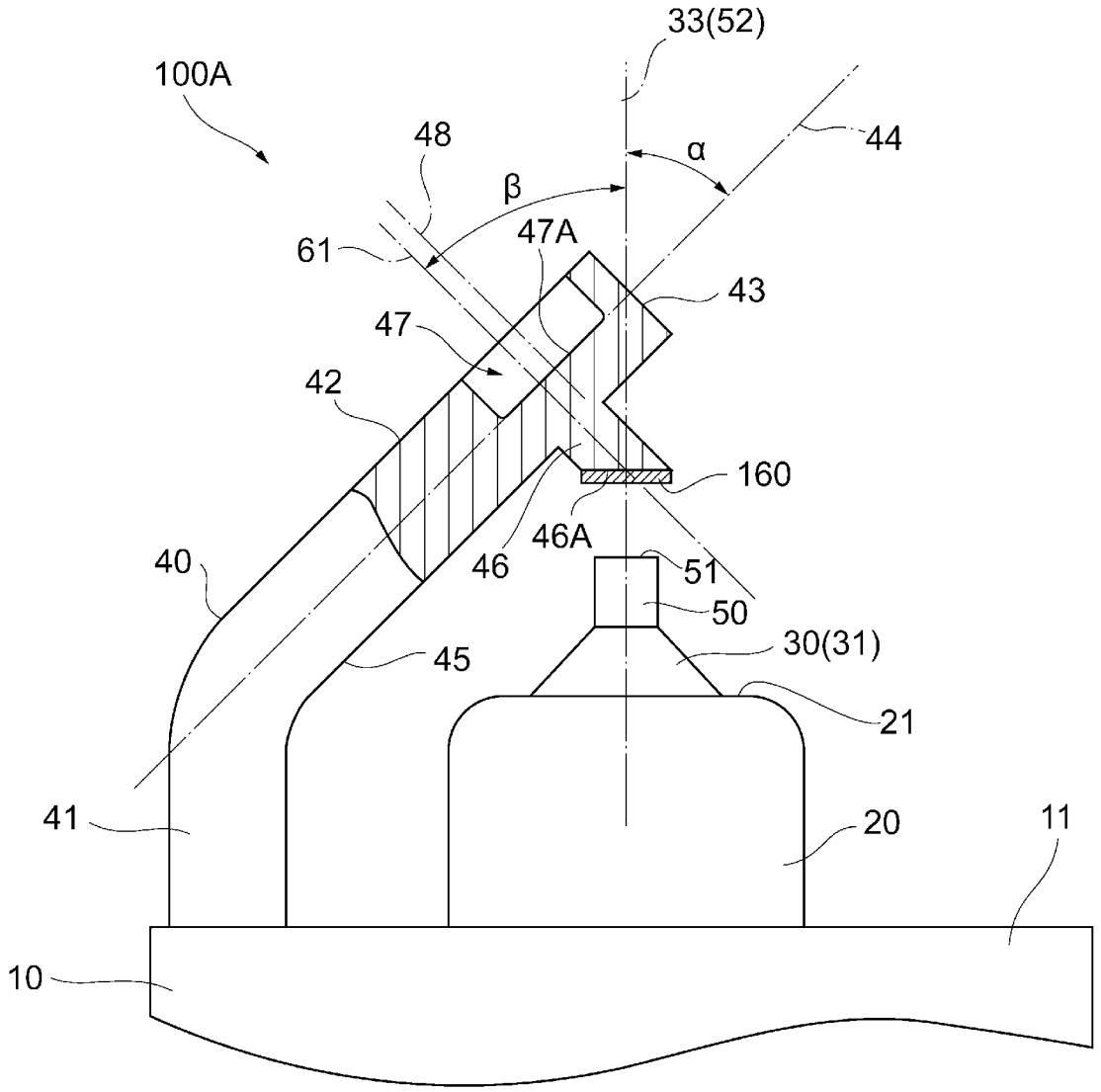
FIG. 6 is an enlarged view of a spark discharge part and its vicinity in a modification example different in configuration of the ground electrode.

Modification examples of the foregoing embodiment will be described with reference to FIGS. 6 and 7.

In the foregoing embodiment, the precious metal layer 60 is applied to the entire surface of the convex portion 46 of the ground electrode 40 as an example. However, the precious metal layer 60 at least needs to be applied to a part of the convex portion 46 including the tip and may not cover the entire surface of the convex portion. As in a spark plug 100A illustrated in FIG. 6, for example, a precious metal layer 160 may be provided only on the convex portion opposed surface 46A of the convex portion 46 of the ground electrode 40. According to this configuration, the ground electrode 40 can be manufactured by, after the formation of the convex portion 46 by extrusion molding, bonding the precious metal layer 160 to the convex portion opposed surface 46A of the convex portion 46 by welding or the like, for example. Accordingly, the precious metal layer 160 can be reliably provided at least on the convex portion opposed surface 46A of the convex portion 46 of the ground electrode 40.

Figure 7:
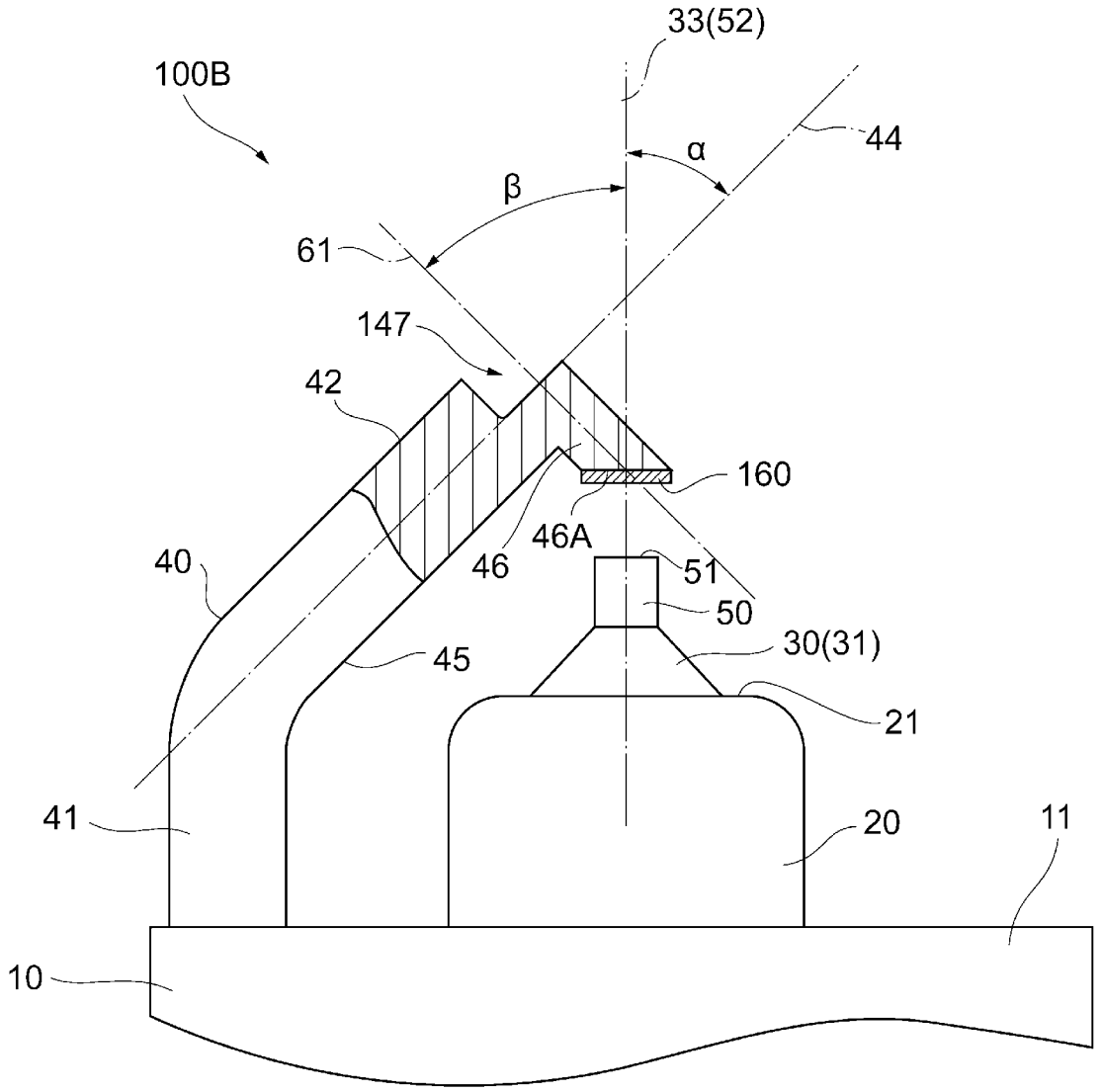
FIG. 7 is an enlarged view of a spark discharge unit and its vicinity in another modification example different in configuration of the ground electrode.

In the case of using the manufacturing method by which the precious metal layer 160 is bonded after extrusion molding, the concave portion 47 can be formed to reach the ground electrode other end surface 43 as in a spark plug 100B illustrated in FIG. 7. Accordingly, the position for the formation of the convex portion 46 can be moved closer to the ground electrode other end surface 43 than that in the foregoing embodiment. This shortens the ground electrode 40 with further excellent heat dissipation properties to improve heat resistance of the ground electrode 40 and prevent reduction in strength of the ground electrode 40.

The present embodiment has been described so far with reference to specific examples. However, the present disclosure is not limited to these specific examples. These specific examples to which a design change is added as appropriate by a person skilled in the art would also fall within the scope of the present disclosure as far as they include the features of the present disclosure. The elements of the specific examples described above and their arrangements, conditions, and shapes are not limited to those exemplified above but can be modified as appropriate. The elements of the specific examples described above can be appropriately changed in combination without any technical inconsistency.

In the foregoing embodiment, the center axis 48 of the concave portion 47 of the ground electrode 40 is shifted toward the other end of the ground electrode 40 (the ground electrode other end surface 43) with respect to the axis 61 of the convex portion 46 as an example. Alternatively, these center axes 48 and 61 may align with each other, that is, the concave portion 47 may be coaxial with the convex portion 46.

In the foregoing embodiment, the convex portion opposed surface 46A of the convex portion 46 of the ground electrode 40 is perpendicular to the axis direction of the center electrode 30, and is arranged to face the end surface of the center electrode 30, that is, the tip surface 51 of the center electrode-side chip 50. However, the convex portion opposed surface 46A does not necessarily need to be perpendicular to the axis direction of the center electrode 30 but the convex portion opposed surface 46A and the tip surface 51 are opposed to each other such that the distances between the opposed portions are approximately identical.

In the foregoing embodiment, the convex portion 46 of the ground electrode 40 is columnar in shape as an example. Alternatively, the convex portion 46 may be formed in any other shape such as a polygonal prismatic shape including triangular prism, square prism, pentagonal prism, or hexagonal prism, or an arbitrary convex columnar shape or concave columnar shape, for example. The corners and sides of the foregoing shape may be rounded, and, out of the processed planes formed by the rounding processing, the plane opposed to the tip surface 51 of the center electrode-side chip 50 of the center electrode 30 may be set as convex portion opposed surface 46A. The convex portion 46 of the ground electrode 40 may have a pyramid shape such as triangular pyramid or square pyramid or a polyhedron shape such as mountain shape, and, out of the plurality of planes of the foregoing shape, the plane opposed to the tip surface 51 of the center electrode-side chip 50 of the center electrode 30 may be set as convex portion opposed surface 46A.

What is claimed is:

1. A spark plug comprising:

a cylindrical mounting bracket attachable to an internal combustion engine;

a center electrode that is held by the mounting bracket in an insulated manner and has a first end portion exposed and extended from a first end portion of the mounting bracket;

a slant-shape ground electrode that has a first end side joined to the first end portion of the mounting bracket, has a surface of a second end side extended to be opposed to the first end portion of the center electrode, and has an extension direction inclined with respect to the center electrode;

a convex portion that protrudes from a base material of the ground electrode on the surface of the ground electrode facing the center electrode, inclines to the center electrode side with respect to a protrusion direction, and has a convex portion opposed surface opposed to an end surface of the center electrode; and a precious metal layer that is formed on at least the convex portion opposed surface out of surfaces of the convex portion; wherein the convex portion is formed such that the convex portion opposed surface is perpendicular to an axial direction of the center electrode; and the convex portion is formed on the one surface of the ground electrode such that a protrusion amount on the ground electrode other end surface side is larger than a protrusion amount on the one end portion side.

2. The spark plug according to claim 1, wherein the convex portion is formed by protruding part of the base material of the ground electrode by extrusion molding, and the precious metal layer is welded to the surface of the ground electrode and then formed by extrusion molding on the surface of the convex portion.

3. The spark plug according to claim 1, wherein the convex portion is formed by protruding a part of the base material of the ground electrode by extrusion molding, and after the formation of the convex portion by the extrusion molding, the precious metal layer is bonded to and formed on the convex portion opposed surface of the convex portion.

4. The spark plug according to claim 1, the spark plug according further comprising:

a concave portion that is formed on a surface of the ground electrode opposite to the surface by recessing part of the base material of the ground electrode along with the formation of the convex portion, and has a bottom surface perpendicular to a recessing direction.

5. The spark plug according to claim 4, wherein a center axis of the concave portion as seen in the recessing direction is shifted to the second end side of the ground electrode with respect to a center axis of the convex portion as seen in the protrusion direction.

6. The spark plug according to claim 1, wherein a cross section of the convex portion is circular in shape.

7. A method for manufacturing a spark plug, the spark plug including:

a cylindrical mounting bracket attachable to an internal combustion engine;

a center electrode that is held by the mounting bracket in an insulated manner and has first end portion exposed and extended from first end portion of the mounting bracket; and a slant-shape ground electrode that has first end side joined to the first end portion of the mounting bracket, has a surface of the second end side extended to be opposed to the first end portion of the center electrode, and has an extension direction inclined with respect to the center electrode, wherein the method comprising:

a convex portion forming step of forming a convex portion that protrudes from a base material of the ground electrode on the surface of the ground electrode facing the center electrode, inclines toward the center electrode with respect to a protrusion direction, and has a convex portion opposed surface opposed to an end surface of the center electrode; and a precious metal layer forming step of forming a precious metal layer on at least the convex portion opposed surface out of surfaces of the convex portion; wherein the convex portion is formed such that the convex portion opposed surface is perpendicular to an axial direction of the center electrode; and the convex portion is formed on the one surface of the ground electrode such that a protrusion amount on the ground electrode other end surface side is larger than a protrusion amount on the one end portion side.

8. The method for manufacturing a spark plug according to claim 7, wherein in the convex portion forming step, the convex portion is formed by protruding part of the base material of the ground electrode by extrusion molding, before the convex portion forming step, a bonding step of bonding the precious metal layer to the surface of the ground electrode is included, and in the precious metal layer forming step, the extrusion molding in the convex portion forming step is performed while the precious metal layer is welded in the bonding step to form the precious metal layer on at least the convex portion opposed surface out of the surface of the convex portion.

9. The method for manufacturing a spark plug according to claim 7, wherein in the convex portion forming step, part of the base material of the ground electrode is protruded by extrusion molding to form the convex portion, and in the precious metal layer forming step, after the formation of the convex portion by the extrusion molding in the convex portion forming step, the precious metal layer is bonded to the convex portion opposed surface of the convex portion to form the precious metal layer on the convex portion opposed surface of the convex portion.

10. The method for manufacturing a spark plug according to claim 7, wherein, in the convex portion forming step, part of the base material of the ground electrode is recessed on a surface of the ground electrode opposite to the surface along with the formation of the convex portion to form a concave portion having a bottom surface perpendicular to a recessing direction.

11. The method for manufacturing a spark plug according to claim 10, wherein in the convex portion forming step, extrusion molding is performed such that a center axis of the concave portion as seen in the recessing direction is shifted to the second end side of the ground electrode with respect to a center axis of the convex portion as seen in the protrusion direction.

12. A spark plug comprising:

a cylindrical mounting bracket attachable to an internal combustion engine;

a center electrode that is held by the mounting bracket in an insulated manner and has a first end portion exposed and extended from a first end portion of the mounting bracket;

a slant-shape ground electrode that has a first end side joined to the first end portion of the mounting bracket, has a surface of a second end side extended to be opposed to the first end portion of the center electrode, and has an extension direction inclined with respect to the center electrode;

a convex portion that protrudes from a base material of the ground electrode on the surface of the ground electrode facing the center electrode, inclines to the center electrode side with respect to a protrusion direction, and has a convex portion opposed surface opposed to an end surface of the center electrode; and a precious metal layer that is formed on at least the convex portion opposed surface out of surfaces of the convex portion; wherein a concave portion that is formed on a surface of the ground electrode opposite to the surface by recessing part of the base material of the ground electrode along with the formation of the convex portion, and has a bottom surface perpendicular to a recessing direction; and a center axis of the concave portion as seen in the recessing direction is shifted to the second end side of the ground electrode with respect to a center axis of the convex portion as seen in the protrusion direction.

* * * * *